United States Patent [19]

Gosse et al.

[11] 3,939,665

[45] Feb. 24, 1976

[54] METHOD FOR PROTECTING METAL H-PILING IN UNDERWATER ENVIRONMENTS AND PROTECTED H-PILING

[75] Inventors: Joseph F. Gosse, Coopersburg; George V. Fehr, Nazareth, both of Pa.

[73] Assignee: Bethlehem Steel Corporation, Bethlehem, Pa.

[22] Filed: Jan. 8, 1974

[21] Appl. No.: 431,814

[52] U.S. Cl. ..... 61/54; 52/170; 52/728

[51] Int. Cl.[2] ..... E02D 5/60

[58] Field of Search ..... 61/54; 52/170, 728; 206/321, 523

[56] References Cited

UNITED STATES PATENTS

| | | | |
|---|---|---|---|
| 433,609 | 8/1890 | Ames | 52/728 |
| 2,928,411 | 3/1960 | Johnson | 61/54 X |
| 3,370,998 | 2/1968 | Wiswell, Jr. | 61/54 X |
| 3,397,260 | 8/1968 | Lamberton | 61/54 |
| 3,553,970 | 1/1971 | Wiswell, Jr. | 61/54 |
| 3,719,049 | 3/1973 | Shaw | 61/54 |
| 3,798,867 | 3/1974 | Starling | 52/729 X |

FOREIGN PATENTS OR APPLICATIONS

| | | | |
|---|---|---|---|
| 648,973 | 12/1964 | Belgium | 52/728 |

*Primary Examiner*—Jacob Shapiro

*Attorney, Agent, or Firm*—Joseph J. O'Keefe; Charles A. Wilkinson

[57] ABSTRACT

A metal H-piling is protected from corrosion in underwater and semi-underwater locations by the application of a coating of a corrosion resistant covering consisting of an outer shield of stiff plastic, an inner layer of a corrosion inhibiting material and a series of expanded plastic clampimg members having an internal shape corresponding substantially to the outer shape and dimensions of the H-piling. The expanded plastic clamping members serve to hold the outer plastic shields, which are preferably in the shape of half sections of the outer dimensions of the H-pile, tightly against the outer surfaces of the H-pile. The clamps, which are preferably in the form of two interlocking sections may be held together by corrosion resistant strapping.

3 Claims, 5 Drawing Figures

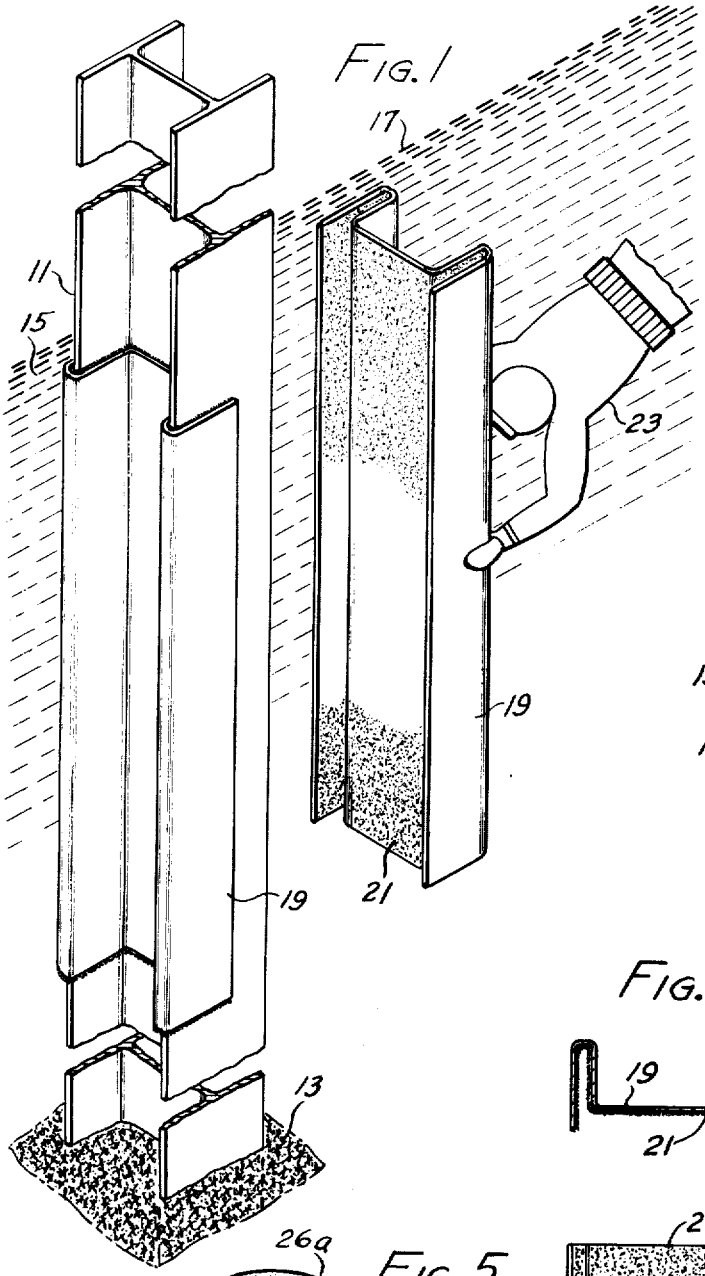
FIG. 1
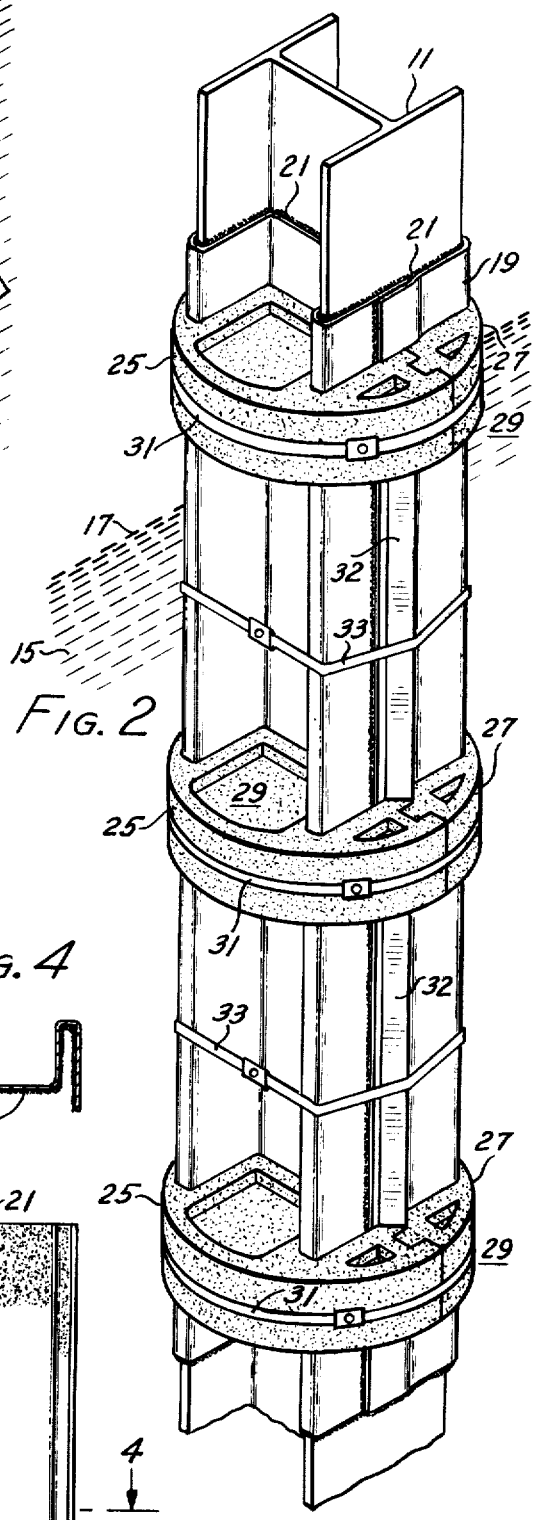
FIG. 2
FIG. 4
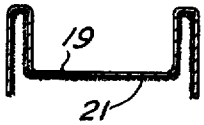
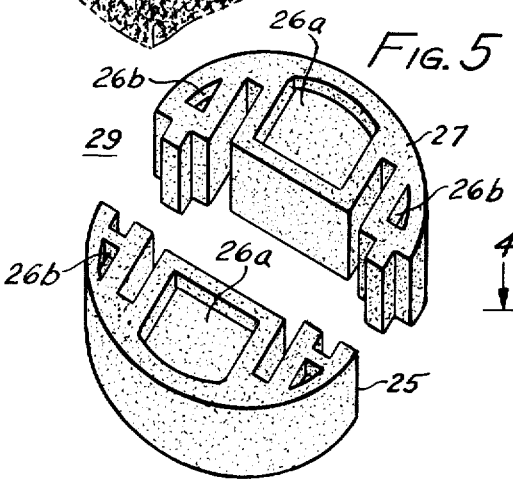
FIG. 5
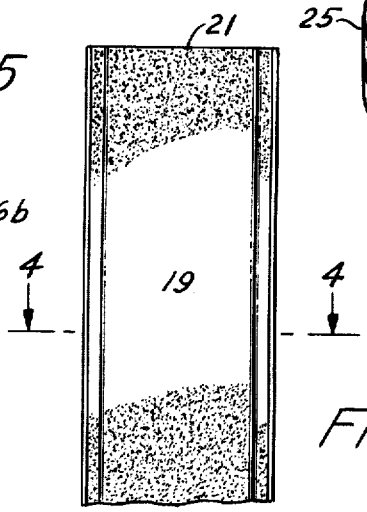
FIG. 3

METHOD FOR PROTECTING METAL H-PILING IN UNDERWATER ENVIRONMENTS AND PROTECTED H-PILING

BACKGROUND OF THE INVENTION

This invention relates to the protection of metal piles from corrosion in underwater and semi-underwater environments and more particularly to the protection of angular metal piles and especially H and I beam type piling from corrosion in such environments.

Metal piles have in recent years widely supplanted the use of wooden and concrete piles for the support of docks, wharves, piers, drilling platforms and other marine structures above the surface of bodies of water. Metal piles are initially stronger and easier to handle and drive into marine sediments than other types of piles. One very economical pile to use is the so-called H-beam or I-beam type pile which is nothing less than the conventional H or I-beam so familiar in other types of structural work. These structural shapes are readily obtainable and easily adaptable to use as piling type supports.

Unfortunately H-beam and I-beam type piling, while strong and rigid for its weight, has large surface areas which, being made of metal, and usually iron, are subject to oxidation and other corrosive attack when exposed to corrosive environments. Iron, as is well known, is not stable when subjected to the usual surface atmospheric conditions. Under such conditions, unprotected iron will oxidize to produce various oxides of iron which are more stable under surface conditions than the uncombined metal. Such oxidation or corrosion, as is well known, is accelerated beneath the surface of bodies of water, especially sea water. Corrosion of metal surfaces and especially iron surfaces is particularly severe in the so-called "splash zone." The splash zone is the zone near the surface of bodies of water, which is alternately exposed to water and air due both to the changing level of tides and the like, the breaking of waves, the spray from waves and various other turbulences coming in contact with metallic structures. Corrosion of untreated metal surfaces is particularly severe in this splash zone and frequently results in a very short useful life for metal structures located in this zone. Very frequently metal piles will be found to be severely corroded and reduced in area in the portions of piles exposed to the splash zone even when corrosion in other portions of the piles is not severe.

Various means have in the past been used to protect metallic members from corrosion under both atmospheric and underwater conditions. Such means have varied from the painting of the surfaces of structures to the provision of internal alloying elements which decrease the oxidation of the metal incorporated in the structures. Such means, which have been found quite suitable under surface or atmospheric conditions, have in general been found to be effective only to a minor degree in the splash zone.

One means of protection known for the prevention of corrosion of underwater metallic structures is the use of sacrificial anodes. Such anodes are mounted near the metal member to be protected, and a portion of the corrosion action is transferred to the more readily corroded anode. Sacrificial anodes are often satisfactory for completely submerged objects but they have little effect upon accelerated corrosion in the splash zone.

Another widely used means for the protection of pilings and other supports from corrosion is a jacket or layer of some noncorrodible or corrosion resistant material placed around the piling or support. it is often difficult to apply such non-corrodible coatings to the pile and they are frequently subject to damage by mechanical abrasion and the like which may destroy the seal with the underlying structure. Most such coatings, furthermore, for example, coatings of brush-on or spray-on paint or the like, are only practical for application prior to the time a pile is installed and are very difficult to repair or brush up once the pile is permanently installed under water. Naturally any thin coating such as a coating of paint is also very easily damaged by abrasion or physical impact of any type.

In recent years coatings composed of sheets of plastic have been applied to underwater piling by means of strapping or the like. Fairly rigid plastic sheets may be handled by divers underwater but are not easily applied to H or I beam type metal piles or other similar irregularly shaped piles.

Various types of forms or coatings for piles have been developed for the coating of piles or the like underwater. The following U.S. patents are representative of disclosures of such prior art coatings.

U.S. Pat. No. 1,013,758 issued Jan. 2, 1912 to Fox et al. discloses a form for the application of concrete to piling. The forms are secured around the pile by means of collars made of segmented sections 3 secured about the forms by means of banding straps 4.

U.S. Pat. No. 2,874,548 issued Feb. 24, 1959 to Drusbel et al. discloses a corrosion resistant plastic shield or sleeve 19 which contains a body of sealing material 27 which excludes water from the space 25 between the sleeve 19 and the metal pile 11. Drusbel states that, "among the materials suitable to fill the space 25 are heavy dielectric greases and asphalts which are sufficiently solid to remain fixed securely in place within the sleeve."

U.S. Pat. No. 3,321,924 issued May 30, 1967 to Liddell discloses the use of a plastic sheet wrapped about a wooden pile and secured with straps to exclude marine borer attack. The plastic sheets are applied in situ by a diver.

U.S. pat. No. 3,370,998 issued Feb. 27, 1968 to Wiswell discloses a corrosion resistant coating for metal piles including H-beam piles. The surface of the pile is first thoroughly cleaned in situ. A plastic resin such as an epoxy resin is then mixed with a curing agent and applied to a preferably porous backing member. Mixing and application to the backing member is preferably done in a mixing tray having rims of a height suitable to contain a layer of plastic of the thickness desired. The porous backing and plastic are then placed onto a metal form having the shape of the piling to be coated and the form is then held against the pile until the plastic cures. The form can either be left against the pile, or, if a suitable separating means such as a polyethylene sheet is inserted between the form and the plastic, the form can be removed after the plastic hardens. The entire assembly of foam plastic and backing member (which may be a fiberglass or other cloth sheet) is installed in place by divers and the assembly is secured in place by straps. In case of an H-beam the forms may be comprised of metal, plywood, masonite or other suitable material.

Such prior disclosures and practices, while effective to various extents to apply corrosion resisting coatings to piling in general, have not been notably successfully in applying corrosion resistant coatings to H or I-type metal piling or other irregularly shaped piling. It has in particular proven very difficult, and in many cases substantially impossible, to obtain a good interfit which is effective to exclude moisture between the inside of the outer plastic coating and the outside of the H or I-pile due to the inconvenient shape of such piling.

SUMMARY OF THE INVENTION

The foregoing difficulties and problems associated with prior art methods of applying corrosion resistant plastic coatings to H and I type metal pilings and other irregularly shaped pilings have now been obviated by the present invention. In accordance with the present invention outer shields of stiff plastic material are coated on the inside with a soft corrosion resistant paste which is preferably of a type which will not harden significantly over a period. The stiff plastic material has previously been formed into a shape which will conform to the outside dimensions of the piling to be protected. preferably two outer partially overlapping shields will be used for each piling. The plastic shields are passed to a diver working underwater who then presses the shields to the outside of the pile. Expanded foam plastic clamping sections are next passed to the diver. Each plastic clamp section has an internal shape conforming to the outside dimensions of the pile. Preferably the clamp sections are in two pieces, each conforming to one half of an H-beam or other angular piling section. The clamp sections may be weighted as they are passed to the diver. The clamps are assembled around the H or I-beam or other type piling over the plastic shield members and are strapped or otherwise secured together, preferably with corrosion resistant metal strapping material. The clamp sections, which are applied over the piling and plastic shield members at spaced intervals, serve to hold or maintain the plastic shields tightly against the surface of the piling and expel all significant water and moisture from between the shield and the pile. At most only a minimal amount of moisture is left between the plastic shields and the surface of the pile and any corrosion inducing properties of this remaining moisture is soon exhausted.

BRIEF DESCRIPTION OF THE DRAWINGS

FIG. 1 is a perspective drawing of an H-pile with the corrosion resistant coating system of the present invention in the process of being applied.

FIG. 2 is an elevation of an H-pile protected by the corrosion resistant coating system of the present invention.

FIG. 3 is a representation of one of the plastic shield members of the present invention prior to application to a pile.

FIG. 4 is a cross section of FIG. 3 at 4–4.

FIG. 5 is an isometric drawing of one of the clamp members of the present invention in disassembled form.

DESCRIPTION OF THE PREFERRED EMBODIMENT

Referring to the appropriate drawings, there is shown a piling 11 which extends into the bottom 13 of a body of water 15 and above the surface 17 of the water. In order to protect the pile, which as shown is an H-pile, but which could as well be an I-beam type pile, or even some other irregular or angular shape of piling, the pile is to be surrounded with a plastic shield or form 19 having a configuration generally conforming to the shape of a portion, and usually half, of the pile. The plastic shield has a corrosion resistant material 21, preferably having a consistency similar to a heavy grease, and which may in fact be comprised in large part of a heavy grease or other petroleum products, applied to the inner surface thereof. The corrosion resistant material will usually have a base comprised of heavy grease to which have been added various other components to attain a desired consistency and corrosion resistance. After a rather cursory removal of large pieces of marine growth and corrosion products from the surface of the pile, the plastic shield members may be passed to a diver 23 under the surface 17 of the water 15, who will apply the plastic shields or forms 19 to the surface of the pile 11 with the corrosion resistant material 21 against the pile surface. The edges of the plastic shields 19 will preferably overlap with each other.

Two sections 25 and 27 of an expanded plastic foam clamp member 29 are next weighted with some suitable means such as a weighted clamp and lowered or passed to the diver 23. Indented portions **26*a* and 26*b* in the surface of the expanded plastic foam sections 25 and 27 serve to decrease the amount of plastic in each section without seriously decreasing the strength or stiffness of the clamp member and in the case of the indented portion 26*a* serve as a convenient place to secure a weighted clamp to the plastic sections to facilitate their hadling under water. The diver will clamp the two plastic foam sections about the plastic-shield or form members and secure them together in clamping position by means of corrosion resistant strapping 31 such as stainless steel or monel metal strapping. other types of strapping, such as silicon bronze strapping, plastic-coated strapping or the like, and other types of corrosion resistant strapping may also be used. The clamp members are preferably applied at about 3 foot intervals along the plastic-shield members 19 and serve to press and maintain the shield member and the underlying corrosion resistant lining material tightly against the pile so that all substantial water is expelled from between the shield and the pile surface. The spacing of the strapping may be varied dependent upon the stiffness of the members 19, the turbulence of the environment, the corrosion resistance of the strapping and other factors. The spacing of the clamp members 29 will depend principally upon the stiffness of the shield members 19** and to a lesser degree upon the turbulence and other like factors of the environment.

Since the edges of the overlapping shield members 19 may tend to pull away from each other between the clamp members 29, it is preferred to pull or press the edges of the plastic shields down tightly against the piling by placing a metal, or preferably a plastic, angle 32 along the overlapping edges and pulling the angle 32 tightly against the shield members 19 and the underlying pile surface by means of tightly applied intermediate strapping 33. The angle 32 acts as an elongated shim means to compress the edges of the shields together. Alternatively, the clamp members 29 themselves may be spaced more closely together to keep the edges of the shield members 19 from spreading. Since the clamp members 19 are, however, principally designed to clamp the shield plastic 19 against the inside webs and flanges of the H-beam and the clamp members effectively do this at fairly wide spread intervals such as about 3 feet apart, it is not normally necesssary to more closely space the clamp members and more economical to use intervening plastic angles or strips as elongated shim means to press the edges of the plastic shields together. The angles 32 may be discontinuous between the clamp members 29 and preferably butted against the upper and lower surfaces of the clamp members, or, as an alternative, may be continuous along the surface of the overlapping portion of the shield members 19, in which case the corresponding portions of the foam plastic clamp members 29 may be cut out slightly to accommodate the angles or, if the plastic foam is fairly resilient or indentable and the angles small, the clamp members can be merely assembled over the tops of the angles allowing the give of the plastic to accommodate to the bulk of the angles. It will also be understood that the angle 32 could be replaced by any elongated stiff structural member. However, an angle is particularly convenient for pressing the edges of the shields 19 together and against the underlying piling.

If desired, the grease like corrosion resistant material may be replaced by an epoxy adhesive or like resin which hardens to provide a permanent bond between the plastic shields and the pile surface. Epoxy and the like is quite expensive for applications such as this, however, and in such instances the surface of the piling will initially have to be rather thoroughly cleaned in order to obtain a good bond between the members. A viscous grease-like non-hardening corrosion resistant material such as described, on the other hand, will effectively exclude water from the surface of the pile without resorting to more than a cursory cleaning of the surface and will thus be found to ordinarily be much more economical and convenient for most applications. Any other water-excluding non-hardening material may also be used.

If the piling has a shape other than that of an H or I-beam the shield members 19 and clamp members 29 will, of course, have an internal shape corresponding to the external shape of the pile to be protected. The internal shape of the clamp members 29 will conform in all cases, of course, to the external shape and dimensions of the shield members 19 when positioned tightly about the piling. The external shape of the shields 19 need not be the same as the external shape of the piling but a more economical use of plastic will normally be attained when the two shapes do correspond. It will be understood that an I-beam maybe considered to be a modified type of H-beam.

I claim:

1. An improved protective corrosion retarding shield assembly for protecting ferrous metal piling having a generally H-shaped cross-section from corrosion in submerged marine environments comprising:

a. a plurality of sheet-like plastic resin shield members having a contour conforming to the outer surface configuration of the H-piling for encompassing the surfaces of the pile in a circumferential close fitting layer of said shield members, b. a viscous corrosion resistant material upon the inner surfaces of the shield members and adapted to be sandwiched between the plastic shield members and the surface of the pile to intimately engage the inner surfaces of the shield members and the outer surfaces of the pile, said viscous material serving to exclude passage of water between said pile and said shield members as long as said shield members are securely clamped against the external surfaces of the pile, and c. a plurality of clamping members comprised of interengaging expanded plastic foam resin clamp sections having an internal surface configuration conforming to the outer surface configuration of the shield members, said internal surface configuration including pairs of spaced grooves for receiving the outer surfaces of the shield members which conform to the flanges of the H-pile and an internal contour between said grooves conforming to the outer surfaces of the portions of the shield members which conform on their internal surfaces to the web portion of the H-pile, for circumferential clamping at spaced intervals about the exterior of the shield members assembled about the surface of the pile and serving to maintain said shield members in a sealing relationship against the exterior surfaces of the pile in order to exclude water from passage between said shield members and said pile surface.

2. An improved protective corrosion retarding shield assembly in accordance with claim 1 wherein said clamp members have a generally circular exterior surface and additionally comprising:

d. corrosion resistant metal strapping secured about the generally circular exterior surface of said clamp members to secure said clamp members firmly about said shield members in a clamping relationship.

3. An improved protective corrosion resistant shield assembly in accordance with claim 2 additionally comprising:

e. substantially rigid elongated shim members for positioning along the edges of the shield members and the pile with strapping to maintain the edges of the shield members tightly against the pile and maintain a sealing relationship between adjacent edges of the shield members and the surface of the pile.

* * * * *